US005989131A

United States Patent [19]

Burkholder

[11] Patent Number: 5,989,131

[45] Date of Patent: Nov. 23, 1999

[54] GOLF WEIGHT TRAINING DEVICE

[76] Inventor: John W. Burkholder, 27552 Berdun, Mission Viejo, Calif. 92691

[21] Appl. No.: 09/208,086

[22] Filed: Dec. 9, 1998

Related U.S. Application Data

[63] Continuation-in-part of application No. 29/083,798, Feb. 17, 1998, Pat. No. Des. 411,277.

[51] Int. Cl.[6] ..... A63B 69/36; A63B 15/00

[52] U.S. Cl. ..... 473/219; 482/109

[58] Field of Search ..... 473/256; 482/109

[56] References Cited

U.S. PATENT DOCUMENTS

| | | | |
|---|---|---|---|
| D. 59,613 | 9/1921 | Thornton et al. . | |
| D. 237,515 | 11/1975 | Thiel | D34/5 CB |
| D. 247,919 | 5/1978 | Goyette, Jr. | D34/5 CB |
| D. 316,888 | 5/1991 | Foresi | D21/234 |
| D. 329,268 | 9/1992 | Perry | D21/234 |
| D. 356,359 | 3/1995 | Bailey | D21/234 |
| D. 368,950 | 4/1996 | Gates | D21/234 |
| D. 371,412 | 7/1996 | Howard | D21/234 |
| 3,231,281 | 1/1966 | Wallo | 473/256 |
| 4,511,147 | 4/1985 | Olsen | 473/256 X |

*Primary Examiner*—George J. Marlo
*Attorney, Agent, or Firm*—Stetina Brunda Garred & Brucker

[57] ABSTRACT

A golf weight training device for improving a golfer's swing during practice therewith. The device comprises an elongate shaft with a top section and an arcuately contoured bottom section defining a bottom end. Advanced over the top section of the shaft is a golf grip used by the golfer to hold the golf weight training device during practice. The bottom section is curved such that the bottom end is laterally offset from a longitudinal shaft axis of the top section. The curved bottom section simulates the position of a club head during the swing and moves the center of gravity of the device outside the swing plane in order to promote proper motion. Generally, the shaft will weigh about 2.5 to 3.5 pounds and be around 29–39 inches in length. The curved bottom section will be formed on the last 6 inches of the shaft such that the bottom end will be laterally offset about 3 inches away from the longitudinal axis of the top section.

10 Claims, 2 Drawing Sheets

GOLF WEIGHT TRAINING DEVICE

RELATED APPLICATIONS

The present invention is a continuation-in-part of U.S. Design patent application Ser. No. 29/083,798 entitled GOLF WEIGHT TRAINING DEVICE filed Feb. 17, 1998, now D U.S. Pat. No. 411,277.

FIELD OF THE INVENTION

The present invention generally relates to golf equipment and specifically to a training device that can improve a golfer's swing.

BACKGROUND OF THE INVENTION

There is currently known in the prior art a wide variety of training devices for improving a golfer's swing. Such devices improve the swing by teaching the proper swing mechanics. When trying to learn the proper technique, the golfer must teach his muscles the proper motion needed to strike the ball effectively. Therefore, it is advantageous for the golfer to repeat the proper swing technique in order for his muscles to develop a memory for the swing such that the correct motion becomes automatic.

In order to drive a golf ball accurately and with distance, the golfer must have the proper positioning of his body during his swing. The golfer must fully rotate his shoulders with his arms extended outward during the backswing of the golf club. Then during the downswing, the golfer's arms and shoulders must rotate forward with the golfer's wrists remaining in a prescribed orientation. Additionally throughout the swing, the golfer's weight must shift between his/her feet. Furthermore, the golfer must accelerate the club head through the impact of the ball and after follow-through.

As can be seen, the proper mechanics of a golf swing are very complicated and must be practiced often in order to achieve maximum performance. The present invention provides an aid for strengthening and learning muscle memory for a correct golf swing. Specifically, the present invention can help promote a correct swing by teaching the golfer's muscles the proper positioning and motion needed while practicing with the device. Additionally, the present invention can promote strength, flexibility and endurance for the golfer.

SUMMARY OF THE INVENTION

In accordance with the preferred embodiment of the present invention, there is provided a golf weight training device for improving a golf swing. The training device comprises an elongate shaft having a top section which defines a top end and an arcuately contoured bottom section which defines a bottom end. The weight of the shaft falls within a range that substantially exceeds the weight range of a conventional golf club. In the preferred embodiment of the present invention, the top section of the shaft defines a longitudinal shaft axis and the bottom end is laterally offset from such axis by a distance of about 3.0 inches. Additionally, the bottom section has a length of about 6.0 inches.

The shaft can be fabricated from a solid metallic material such as cold rolled steel or stainless steel. As such, the weight of the shaft is in the range of about 2.5 pounds to 3.5 pounds. Additionally, the length of the shaft is in the range of about 29.0 inches to 39.0 inches and has a diameter of about 0.625 inches. In accordance with the preferred embodiment of the present invention, the top section may be linear and further comprise a grip attached thereto.

BRIEF DESCRIPTION OF THE DRAWINGS

These as well as other features of the present invention, will become more apparent upon reference to the drawings wherein.

DETAILED DESCRIPTION OF THE PREFERRED EMBODIMENT

Figure 1:
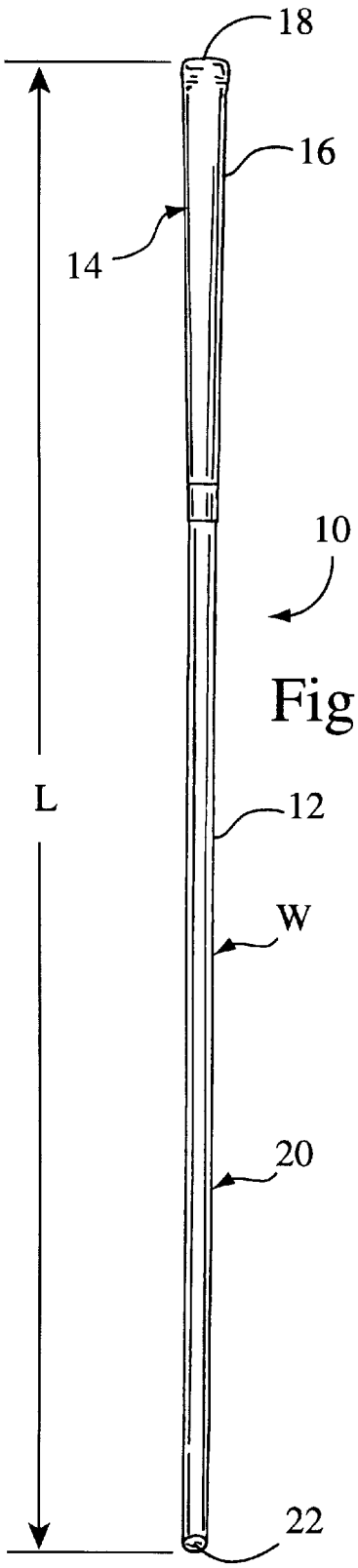
FIG. 1 is a front elevational view of a golf weight training device constructed in accordance with the preferred embodiment of the present invention.

Referring now to the drawings wherein the showings are for purposes of illustrating a preferred embodiment of the present invention only, and not for purposes of limiting the same, FIG. 1 is a front elevational view of the golf weight training device 10. The training device 10 is fabricated from an elongate shaft 12 of metallic material such as stainless steel or cold rolled steel. However, the shaft 12 may be formed from other types of materials that give the shaft 12 the necessary weight to be used as a practicing device, as will be explained in greater detail below. Furthermore, it is contemplated that the shaft 12 may be hollow such that weights can be inserted therein, or that the shaft 12 be constructed out of multiple sections that can be threadably engagable to each other in order to give the shaft 12 the necessary weight and/or length for practice therewith. In the preferred embodiment of the present invention, the shaft 12 has a length L in the range of 29 inches to 39 inches and has a weight W in the range of 2.5 pounds to 3.5 pounds. Additionally, the shaft 12 will have a diameter D of about 0.625 inches. However, as will be described in further detail below, the length and weight of shaft 12 may be varied for different levels of experience.

Figure 4:
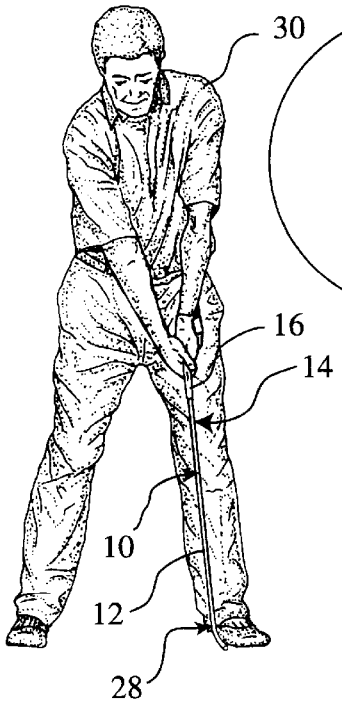
FIGS. 4–7 are perspective views illustrating a preferred manner of using the present golf weight training device to practice a typical golf swing.

The golf weight training device 10 constructed in accordance with the preferred embodiment comprises a generally linear top section 14 that defines a top end 18. As seen in FIG. 4, a golfer 30 holds the device 10 with a standard golf grip at top section 14. Accordingly, a golf grip 16 is advanced over the top section 14 of the shaft 12 in order to provide a firm gripping surface for the hands of the golfer 30. The golf grip 16 is sized such that the inner diameter of the grip 16 is slightly larger than the diameter of shaft 12 so that the grip 16 may be frictionally retained thereon. As will be recognized by those of ordinary skill in the art, the grip 16 may be constructed from the same material used for golf club grips in order to facilitate practicing with the device 10.

Figure 2:
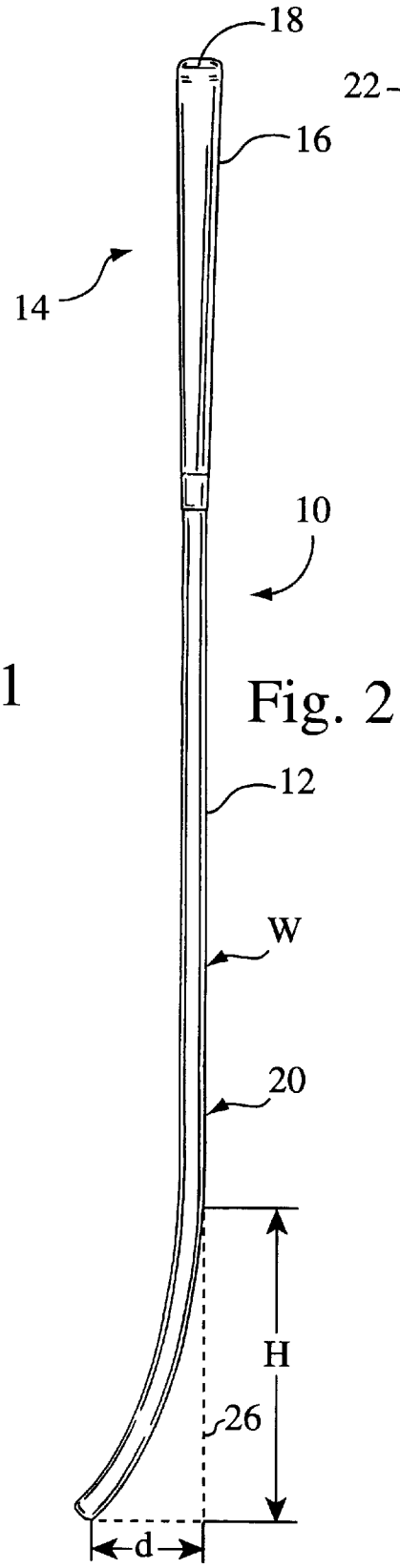
FIG. 2 is a side elevational view of the golf weight training device shown in FIG. 1.
Figure 3:
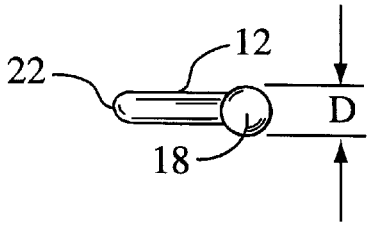
FIG. 3 is a top plan view of the golf weight training device shown in FIG. 1.

As seen in FIGS. 2 and 3, the shaft 12 of the golf weight training device 10 comprises a bottom section 20 that is arcuately contoured. The bottom section 20 defines a bottom end 22 that is laterally offset a distance d of about 3.0 inches from a longitudinal axis 26 of the top section 14 as seen in FIG. 2. As such, a curve 28 is formed by bending the bottom end 22 of shaft 12 away from the longitudinal axis 26 of top section 14. In accordance with the preferred embodiment of the present invention, usually the curve 28 will have a length H of about 6.0 inches on the bottom section 20 in order to facilitate proper swing movement during practice sessions.

The J-shaped golf weight training device 10 provides a unique golf swing practicing system that teaches the proper mechanics of a golf swing. As seen in FIG. 4, the golfer 30 can simulate the starting position for a proper swing. Specifically, the golfer 30 will grip the device 10 as he would a golf club in order to teach his muscles the proper positioning and motion needed for a correct swing during practice sessions with the device 10. The curve 28 in shaft 12 simulates the position of the clubhead and the shaft 12 simulates the shaft of a golf club. Therefore, the device 10 can help the golfer 30 simulate the correct starting position for his body before starting his swing. From the starting position of FIG. 4, the golfer 30 will practice his swing by swinging the device 10 backwards.

Figure 5:
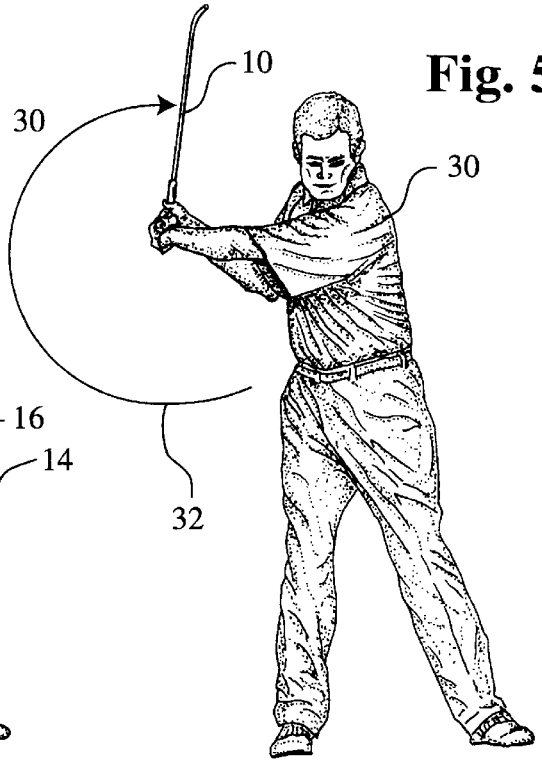

Referring now to FIG. 5, the golfer 30 has swung his golf weight training device 10 to a vertical position above his hands. As seen by backswing arrow 32, the golfer 30 has advanced the device 10 with his arms and shoulders and kept his wrists in a prescribed position. The weight of the device 10 forces the muscles of the golfer 30 into the proper position during his backswing. Specifically, the golf weight training device 10 promotes full extension of the arms and full rotation of the shoulders of golfer 30 during backswing because the weight of the shaft 12 pulls the arms and shoulders of golfer 30 into the correct position as it is being swung back. As the shaft 12 is being swung back, it produces a centrifugal force away from the body of golfer 30. This force promotes proper positioning of the muscles of golfer 30 because the weight of the shaft 12 is substantially greater than the weight of a conventional golf club that typically weighs about 16 ounces. Therefore, the device 10 promotes proper backswing motion during practice.

Figure 6:
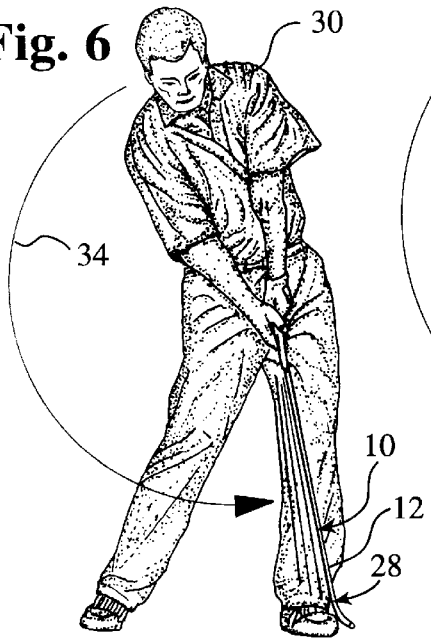

FIG. 6 depicts a golfer 30 using the golf weight training device 10 during a downswing portion 34 of his swing and simulated impact point with the ball. The curve 28 in shaft 12 simulates the positioning of the golfer's clubhead at impact point such that the golfer 30 can practice proper clubhead positioning while using the device 10. Additionally the curve 28 in the shaft 12 increases the rotational force through hitting by moving the center of gravity of the device 10 outside of the plane of the swing. The increase in the rotational force in the shaft 12 about the longitudinal axis 26 additionally promotes proper release of the wrists of golfer 30. The weighted shaft 12 also promotes an initial downswing with the shoulders and arms rather of golfer 30 rather than from his wrists.

Figure 7:
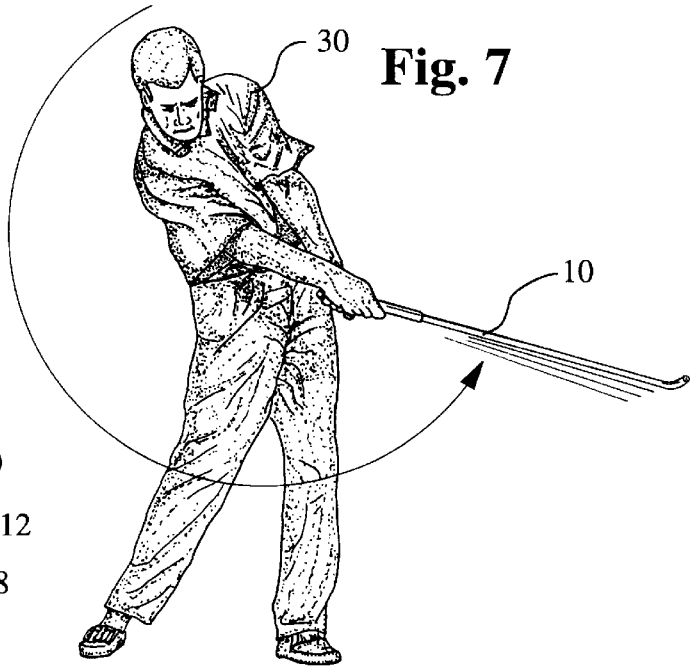

Referring now to FIG. 7, the golfer 30 is now in the follow-through portion of his swing. The device 10 promotes full extension and acceleration during follow-through from the weight of the device 10. Therefore, the device 10 can simulate proper follow-through motion at the end of the swing as well as promote proper acceleration of the clubhead throughout the swing.

When used properly during practice, the golf weight training device 10 can simulate the proper motion needed to swing a golf club effectively. When the golfer 30 swings the device 10 as he would a golf club, the weight of the shaft 12 will strengthen and accelerate his muscle memory during practice. The centrifugal force created by swinging the shaft 12 enhances the feel of positioning and full extension of the golfer's body such that the golfer 30 may reinforce proper movement. With repeated use of the training device 10, the muscles of golfer 30 will "remember" the correct positioning and movement needed for a proper swing. Additionally, the weighted shaft 12 enhances the feel of the movement of the device 10 such that the golfer 30 can work on his tempo and his transition from backswing to downswing thereby promoting a smoother swing. The training device 10 also enhances the feel of the golfer's weight being transferred between his legs during the swing due from the weight of the shaft 12 being greater than the weight of a conventional golf club. Furthermore, the weight of the device 10 can strengthen the grip of the golfer 30 to prevent casting.

The golf weight training device 10 can also be used as a warm-up tool before a round of golf or at the driving range. As such, the golf weight training device 10 can lessen the chance of injury to the golfer 30 when used prior to play or practice by warming up the muscles that the golfer 30 will use. Additionally, the weighted shaft 12 of the device 10 promotes increased strength, flexibility and endurance through practice. As will be recognized by those of ordinary skill in the art, the length and weight of the shaft 12 may be varied for different types of golfers. As such, beginners and/or small golfers may wish to start with a lighter training device 10 in order to practice their technique, while more experienced golfers may want to use a heavier training device 10 in order to build strength and endurance. Therefore, it is contemplated that the shaft 12 may be varied and adjustable as previously described to accommodate all types of golfers.

Additional modifications and improvements of the present invention may also be apparent to those of ordinary skill in the art. Thus, the particular combination of parts described and illustrated herein is intended to represent only a preferred embodiment of the present invention, and is not intended to serve as limitations of alternative devices within the spirit and scope of the invention.

What is claimed is:

1. A golf weight training device for improving a golf swing, comprising:

an elongate, substantially solid shaft having a top section which defines a top end and an arcuately contoured bottom section which defines a bottom end;

the shaft being formed to be of a weight which is within the range of between 2.5 pounds to 3.5 pounds and is evenly distributed between the top end and the bottom end of the shaft.

2. The golf weight training device of claim 1 wherein the top section of the shaft defines a longitudinal shaft axis and the bottom end is laterally offset from the shaft axis by a distance of 3.0 inches.

3. The golf weight training device of claim 2 wherein the bottom section has a length of 6.0 inches.

4. The golf weight training device of claim 1 wherein the shaft is fabricated from a metallic material.

5. The golf weight training device of claim 4 wherein the metallic material is stainless steel.

6. The golf weight training device of claim 4 wherein the metallic material is cold rolled steel.

7. The golf weight training device of claim 1 wherein the shaft has a diameter of about 0.625 inches.

8. The golf weight training device of claim 1 further comprising a grip attached to the top section of the shaft.

9. The golf weight training device of claim 1 wherein the shaft has a length in the range of 29.0 inches to 39.0 inches.

10. The golf weight training device of claim wherein the top section is generally linear.

* * * * *